US011006196B1

(12) United States Patent
Park et al.

(10) Patent No.: US 11,006,196 B1
(45) Date of Patent: May 11, 2021

(54) EARPHONE HAVING NOZZLE-INTEGRATED STRUCTURE WITH DRUM SAFETY FILTER APPLIED THERETO

(71) Applicant: BUJEON CO., LTD., Ansan-si (KR)

(72) Inventors: Minkoo Park, Hwaseong-si (KR); Seungwoo Chun, Hwaseong-si (KR); Halim Kim, Ansan-si (KR)

(73) Assignee: BUJEON CO., LTD., Ansan-si (KR)

( * ) Notice: Subject to any disclaimer, the term of this patent is extended or adjusted under 35 U.S.C. 154(b) by 7 days.

(21) Appl. No.: 16/777,910

(22) Filed: Jan. 31, 2020

(30) Foreign Application Priority Data

Dec. 17, 2019 (KR) ..... 20-2019-0005108

(51) Int. Cl.

| | |
|---|---|
| ***H04R 1/10*** | (2006.01) |
| ***H04R 7/18*** | (2006.01) |
| ***H04R 9/02*** | (2006.01) |
| ***H04R 7/12*** | (2006.01) |
| ***H04R 9/06*** | (2006.01) |

(52) U.S. Cl.
CPC ..... *H04R 1/1008* (2013.01); *H04R 1/1075* (2013.01); *H04R 7/12* (2013.01); *H04R 7/18* (2013.01); *H04R 9/025* (2013.01); *H04R 9/06* (2013.01)

(58) Field of Classification Search
CPC ..... H04R 1/1008; H04R 1/1075; H04R 7/12; H04R 7/18; H04R 9/025; H04R 9/06
USPC ..... 381/380, 381, 382
See application file for complete search history.

(56) References Cited

U.S. PATENT DOCUMENTS

| | | | | |
|---|---|---|---|---|
| 10,009,680 | B2 | 6/2018 | Briggs et al. | |
| 2011/0158457 | A1* | 6/2011 | Ishizaka | H04R 1/12 381/380 |
| 2014/0348372 | A1* | 11/2014 | Seo | H04R 1/1016 381/380 |

FOREIGN PATENT DOCUMENTS

| | | | |
|---|---|---|---|
| JP | 5164652 | B2 | 3/2013 |
| KR | 10-0825335 | B1 | 4/2008 |
| KR | 10-1897669 | B1 | 10/2018 |
| KR | 10-1974967 | B1 | 5/2019 |

* cited by examiner

*Primary Examiner* — Alexander Krzystan
*Assistant Examiner* — Julie X Dang
(74) *Attorney, Agent, or Firm* — Korus Patent, LLC; Seong Il Jeong

(57) ABSTRACT

Disclosed herein is an earphone having a nozzle-integrated structure with a DSF applied thereto. The earphone includes: a housing formed as a penetrated body, and configured such that a nozzle portion is provided therein; a retainer configured to be fastened inside the housing; a magnet configured to generate magnetic force; a yoke configured to concentrate magnetic force; a plate configured to collect magnetic force; a voice coil configured to generate a magnetic field and vibrate through the interaction with the magnet; and a diaphragm configured to vibrate and generate sound. A penetrated sleeve is provided inside the housing and forms a nozzle portion. A drum safety filter (DSF) hole is formed in one side of the edge of a seating surface and a mesh member is disposed below a portion of the retainer in which the DSF hole is formed.

12 Claims, 5 Drawing Sheets

EARPHONE HAVING NOZZLE-INTEGRATED STRUCTURE WITH DRUM SAFETY FILTER APPLIED THERETO

CROSS-REFERENCE TO RELATED APPLICATION

This application claims the benefit of Korean Utility Model Registration Application No. 20-2019-0005108 filed on Dec. 17, 2019, which is hereby incorporated by reference herein in its entirety.

BACKGROUND

1. Technical Field

The present invention relates generally to an earphone having a nozzle-integrated structure with a drum safety filter (DSF) applied thereto, and more specifically to an earphone having a nozzle-integrated structure with a DSF applied thereto, which is capable of relieving eardrum pressure when an earphone having the nozzle-integrated structure is inserted and worn into the ear.

2. Description of the Related Art

In general, an earphone is a device that converts electrical energy into acoustic energy. An earphone does not aim to radiate sound into space, but transmits vibration to the ear's eardrum so that a user listens to sound. An earphone is usually inserted into and used in the ear hole.

Such earphones are classified into magnetic earphones including a permanent magnet, a voice coil, and a diaphragm, dynamic earphones having a movable coil attached to a diaphragm, and piezoelectric earphones using a piezoelectric element.

When such an earphone is worn in the ear or while a user is wearing such an earphone, the inside of the ear is clogged due to the earphone having a housing of a certain shape, and thus high pressure is formed inside the ear canal, thereby causing inconvenience to the user and also deteriorating sound quality. Basically, research is being conducted in order to solve the above problems.

However, despite the problem in which pressure is exerted on the eardrum when the earphone is inserted into the ear, it is not easily improved.

In addition, the eardrum is a part that vibrates and transmits sound entering from the outside through the ear canal of the ear. Accordingly, an earphone applies pressure onto the eardrum, and thus problems arise in that a feeling of wearing is deteriorated, discomfort is increased during use, and it is difficult for the eardrum to perform its function.

In particular, an earphone having an integrated nozzle has the problem of applying increased pressure onto the eardrum when worn in the ear.

Meanwhile, in connection with the prior art, there are not many technologies for relieving eardrum pressure that occurs when an earphone is worn in the ear.

In the prior art, Korean Patent No. 10-0825335 proposes a structure in which a duct is formed, Japanese Patent No. 5164652 proposes a structure in which a duct is blocked with a mesh to thus maintain sound pressure and prevent moisture infiltration, and U.S. Pat. No. 10,009,680 proposes a bridge and retainer structure. However, the prior art is technically different from the present invention to be described below in terms of structure and functionality.

SUMMARY

The present invention has been conceived to overcome the above-described problems, and an object of the present invention is to provide an earphone having a nozzle-integrated structure with a DSF applied thereto, which is capable of relieving eardrum pressure applied to the eardrum located at an end of the ear canal when the earphone having a nozzle-integrated structure is inserted and worn into the ear.

An object of the present invention is to provide an earphone having a nozzle-integrated structure with a DSF applied thereto, which is capable of relieving eardrum pressure by being combined with a DSF structure in which a DSF hole and a mesh are disposed in a communication path through which the sound of the nozzle-integrated earphone is transferred.

In order to accomplish at least one of the above objects, the present invention provides an earphone having a nozzle-integrated structure with a DSF applied thereto, the earphone including: a housing formed as a penetrated body forming the appearance of the earphone, and configured such that a nozzle portion is provided therein in an integrated structure; a retainer configured to have a penetrated structure and to be fastened inside the housing; a magnet configured to be fastened onto the retainer and to generate magnetic force; a yoke configured to be located beneath the magnet and to concentrate magnetic force; a plate configured to be located over the magnet and to collect magnetic force in a vertical direction; a voice coil configured to be located on a side of the magnet and the plate, and to, when an electric signal having sound is applied, generate a magnetic field and vibrate through the interaction with the magnet; and a diaphragm configured to be fastened to the top of the retainer, to be located above the plate, and to vibrate and generate sound in response to the vibration of the voice coil; wherein a penetrated sleeve protruding upward from the lower end of the housing is provided inside the housing and forms a nozzle portion; wherein the retainer is fastened to the upper end portion of the penetrated sleeve; and wherein a drum safety filter (DSF) hole is formed in one side of the edge of a seating surface, on which the retainer-side diaphragm is seated, to communicate in a lateral direction, and a mesh member is disposed below a portion of the retainer in which the DSF hole is formed.

In order to accomplish at least one of the above objects, the present invention provides an earphone having a nozzle-integrated structure with a DSF applied thereto, the earphone including: a housing formed as a penetrated body forming the appearance of the earphone, and configured such that a nozzle portion is provided therein in an integrated structure; a retainer configured to have a penetrated structure and to be fastened inside the housing; a magnet configured to be fastened onto the retainer and to generate magnetic force; a yoke configured to be located beneath the magnet and to concentrate magnetic force; a plate configured to be located over the magnet and to collect magnetic force in a vertical direction; a voice coil configured to be located on a side of the magnet and the plate, and to, when an electric signal having sound is applied, generate a magnetic field and vibrate through the interaction with the magnet; and a diaphragm configured to be fastened to the top of the retainer, to be located above the plate, and to vibrate and generate sound in response to the vibration of the voice coil; wherein a penetrated sleeve protruding upward from the lower end of the housing is provided inside the housing and forms a nozzle portion; wherein the retainer is fastened to the upper end portion of the penetrated sleeve; and wherein a drum safety filter (DSF) hole is formed in one side of the edge of a seating surface on which the retainer-side diaphragm is seated and also formed to communicate in a lateral direction, and a mesh member is interposed between the retainer and the diaphragm to be connected with the DSF hole, formed in a ring-shaped structure, and disposed to cover an overall edge of the diaphragm.

In order to accomplish at least one of the above objects, the present invention provides an earphone having a nozzle-integrated structure with a DSF applied thereto, the earphone including: a housing formed as a penetrated body forming the appearance of the earphone, and configured such that a nozzle portion is provided therein in an integrated structure; a retainer configured to have a penetrated structure and to be fastened inside the housing; a magnet configured to be fastened onto the retainer and to generate magnetic force; a yoke configured to be located beneath the magnet and to concentrate magnetic force; a plate configured to be located over the magnet and to collect magnetic force in a vertical direction; a voice coil configured to be located on a side of the magnet and the plate, and to, when an electric signal having sound is applied, generate a magnetic field and vibrate through the interaction with the magnet; and a diaphragm configured to be fastened to the top of the retainer, to be located above the plate, and to vibrate and generate sound in response to the vibration of the voice coil; wherein a penetrated sleeve protruding upward from the lower end of the housing is provided inside the housing and forms a nozzle portion; wherein the retainer is fastened to the upper end portion of the penetrated sleeve; and wherein a drum safety filter (DSF) hole is formed in one side of the edge of the upper end portion of the retainer to communicate in a lateral direction, and a mesh member is interposed between the retainer and the diaphragm and disposed only over a portion in which the DSF hole is formed.

In order to accomplish at least one of the above objects, the present invention provides an earphone having a nozzle-integrated structure with a DSF applied thereto, the earphone including: a housing formed as a penetrated body forming the appearance of the earphone, and configured such that a nozzle portion is provided therein in an integrated structure; a retainer configured to have a penetrated structure and to be fastened inside the housing; a magnet configured to be fastened onto the retainer and to generate magnetic force; a yoke configured to be located beneath the magnet and to concentrate magnetic force; a plate configured to be located over the magnet and to collect magnetic force in a vertical direction; a voice coil configured to be located on a side of the magnet and the plate, and to, when an electric signal having sound is applied, generate a magnetic field and vibrate through the interaction with the magnet; and a diaphragm configured to be fastened to the top of the retainer, to be located above the plate, and to vibrate and generate sound in response to the vibration of the voice coil; wherein a penetrated sleeve protruding upward from the lower end of the housing is provided inside the housing and forms a nozzle portion; wherein the retainer is fastened to the upper end portion of the penetrated sleeve; and wherein a mesh member is interposed upright between one side wall of a seating surface, on which the retainer-side diaphragm is seated, and the diaphragm, a DSF groove is formed in one side of an edge of the seating surface on which the retainer-side diaphragm is seated, and a DSF hole is formed in one side wall of the retainer to be connected to the DSF groove.

A mounting recess may be formed in the upper portion of the inner surface of the retainer, and the magnet, the yoke and the plate may be fastened by being stacked and fitted into the mounting recess.

A fastening protrusion protruding inward may be formed on the upper end portion of the inner surface of the sleeve, a fastening recess corresponding to the fastening protrusion of the sleeve may be formed in the outer surface of the retainer, and the retainer may be fitted into the sleeve via the fastening protrusion and the fastening recess.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Figure 1:
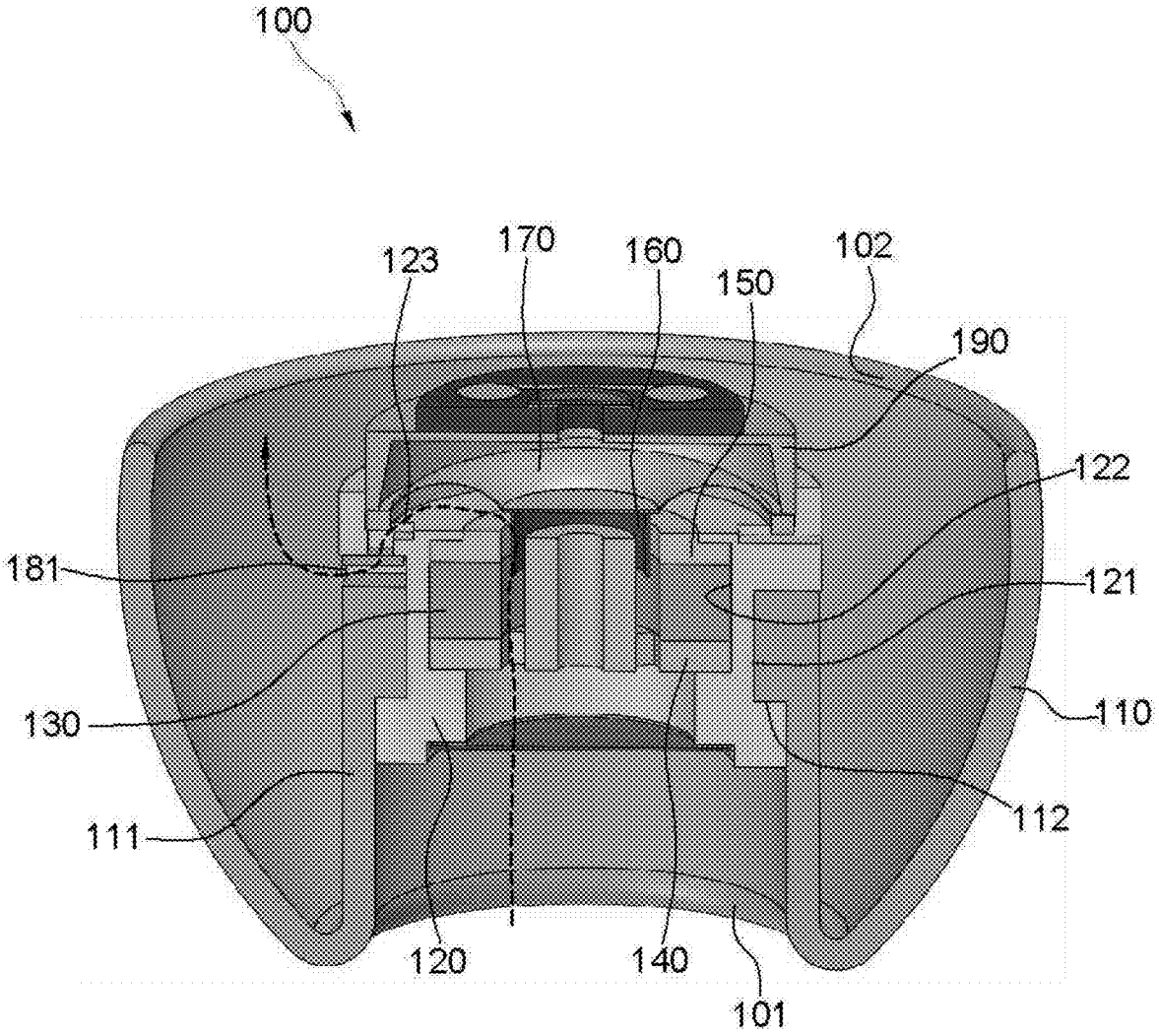
FIG. 1 is a diagram illustrating the configuration of an earphone having a nozzle-integrated structure with a DSF applied thereto according to an embodiment of the present invention.

The objects and effects of the present invention and the technical configurations for achieving them will become apparent by reference to the embodiments to be described in detail below in conjunction with the accompanying drawings. In the following description of the present invention, when it is determined that a detailed description of a well-known function or configuration may unnecessarily make the gist of the present invention obscure, the detailed description thereof will be omitted.

Throughout the specification and the claims, when any portion is described as including any component, this means that the portion may further include another component rather than excluding the other component. Meanwhile, in the embodiments of the present invention, each component, function block, or means may be constructed using one or more sub-components, and an electrical, electronic, or mechanical function performed by each component may be implemented using one or more of various devices, such as an electronic circuit, an integrated circuit, an application-specific integrated circuit (ASIC), etc., and various mechanical elements. Such components may be implemented separately, or two or more components may be integrated into one component.

The directionalities of "upper side" and "lower side" described in the specification are mainly based on the states shown in the drawings for ease of description, but are not limited thereto. Such directionalities may vary depending on the state in which components are disposed.

As shown in FIG. 1, an earphone 100 having a nozzle-integrated structure with a DSF applied thereto according to an embodiment of the present invention includes a housing 110, a retainer 120, a magnet 130, a yoke 140, a plate 150, a voice coil 160, and a diaphragm 170.

The housing 110 is a penetrated body forming the appearance of the earphone 100, and is configured such that a nozzle portion is provided in an integrated structure and openings 101 and 102 are formed in upper and lower sides and provided to form a communication path.

In this case, the upper opening 101 is a portion that faces the ear canal and eardrum of a human when the earphone 100 is worn in the ear.

The upper opening 101 of the housing 110 may have a larger diameter than the lower opening 102 of the housing 101.

The housing 110 is provided to function to allow a sound conversion unit, including the magnet 130, the yoke 140, the plate 150, the voice coil 160 and the diaphragm 170, to be disposed therein and to protect it.

Inside the housing 110, a penetrated sleeve 111 protruding upward from the lower end portion of the housing 110 is provided and forms the nozzle portion and the retainer 120 is fixedly disposed at the upper end of the penetrated sleeve 111.

For this purpose, a fastening protrusion 112 protruding inward is provided on the upper end portion of the inner surface of the sleeve 111.

The retainer 120 is a fastening member configured to have a penetrated structure and to be fastened to the inside of the housing 110, and is a component configured to fasten the magnet 130, the yoke 140 and the plate 150 to the inside of the housing 110 having a nozzle-integrated structure.

The retainer 120 is responsible for an important role for applying a DSF structure in order to relieve eardrum pressure when the earphone 100 is worn in the ear, which will be described below.

A fastening recess 121 having a shape corresponding to the fastening protrusion 112 of the sleeve 111 is formed in the outer surface of the retainer 120, and the retainer 120 is fitted into the sleeve 111 of the housing 110.

A mounting recess 122 is formed in the upper end portion of the inner surface of the retainer 120 in a stepped structure, and the magnet 130, the yoke 140 and the plate 150 are stacked on each other and fitted into the mounting recess 122.

The magnet 130 is fastened onto the retainer 120, generates magnetic force, and is made of a magnetic material having magnetism.

The magnet 130 may be a permanent magnet.

The magnet 130 may be formed in the shape of a ring body or a cylindrical body.

The magnet 130 may be disposed in a P- or F-type structure as desired.

The yoke 140 is a component configured to be located beneath the magnet 130 and to concentrate magnetic force, and functions to obtain high-density uniform magnetic force by concentrating the magnetic force generated by the magnet 130.

The yoke 140 may be made of a paramagnetic material such as iron (Fe), which is a material that is weakly magnetized in the direction of a magnetic field when it is inserted into the magnetic field and is not magnetized when a magnetic field is removed.

The yoke 140 may be formed in the shape of a cylindrical body at the center of the magnet 230 when the magnet 230 is formed in the shape of a ring body.

Furthermore, the yoke 140 may be formed in the shape of a ring body to surround the magnet 130 when the magnet 130 is formed in the shape of a cylindrical body.

The present invention shows an example of the former case.

The plate 150 is located over the magnet 130, and functions to collect magnetic force in a vertical direction and to also fasten the diaphragm 170.

The voice coil 160 is located on a side of the magnet 130 and the plate 150, and functions to, when an electric signal having sound is applied, form a magnetic field and vibrate through interaction with the magnet 130.

The voice coil 160 may be disposed inside or outside the magnet 130 and the plate 150.

The diaphragm 170 is fastened to the top of the retainer 120 and located above the plate 150, and functions to vibrate and generate sound in response to the vibration of the voice coil 160.

As the diaphragm 170 is seated and disposed on the seating surface of the upper end portion of the retainer 120, it is supported and fastened onto the side walls **120*a*** of the retainer.

In other words, the diaphragm 170 is disposed by being inserted into the retainer 120.

In this case, the fastening element 190 may be fastened to the retainer 120 to press the diaphragm 170 in order to increase fastening force for the diaphragm 170.

In the present invention, a DSF structure configured to relieve eardrum pressure when the earphone 100 is worn in the ear is added to the above-described configuration. The present invention may be configured in various forms.

In a first embodiment, the DSF structure that is applied to the nozzle-integrated earphone 100 is configured such that a DSF hole 123 is formed in one side of the edge of the seating surface on which the retainer 120-side diaphragm 170 is seated, is formed to communicate in a lateral direction and a mesh member 181 is disposed to cover only the DSF hole 123 below the portion of the retainer 120, in which the DSF hole 123 is formed, in order to match the DSF hole 123.

In the DSF structure according to the first embodiment, the flow of pressurized air and sound is sent from the lower opening 101 through the yoke 140, the magnet 130 and the diaphragm 170, is passed through the DSF hole 123, is filtered while being passed through the mesh member 181, and is then transferred to the eardrum through the upper opening 102.

In this case, due to the operation of the DSF structure in which the DSF hole 123 and the mesh member 181 are combined together, there may be provided the advantage of relieving eardrum pressure that frequently occurs when an earphone having a nozzle-integrated structure is worn in the ear.

Figure 2:
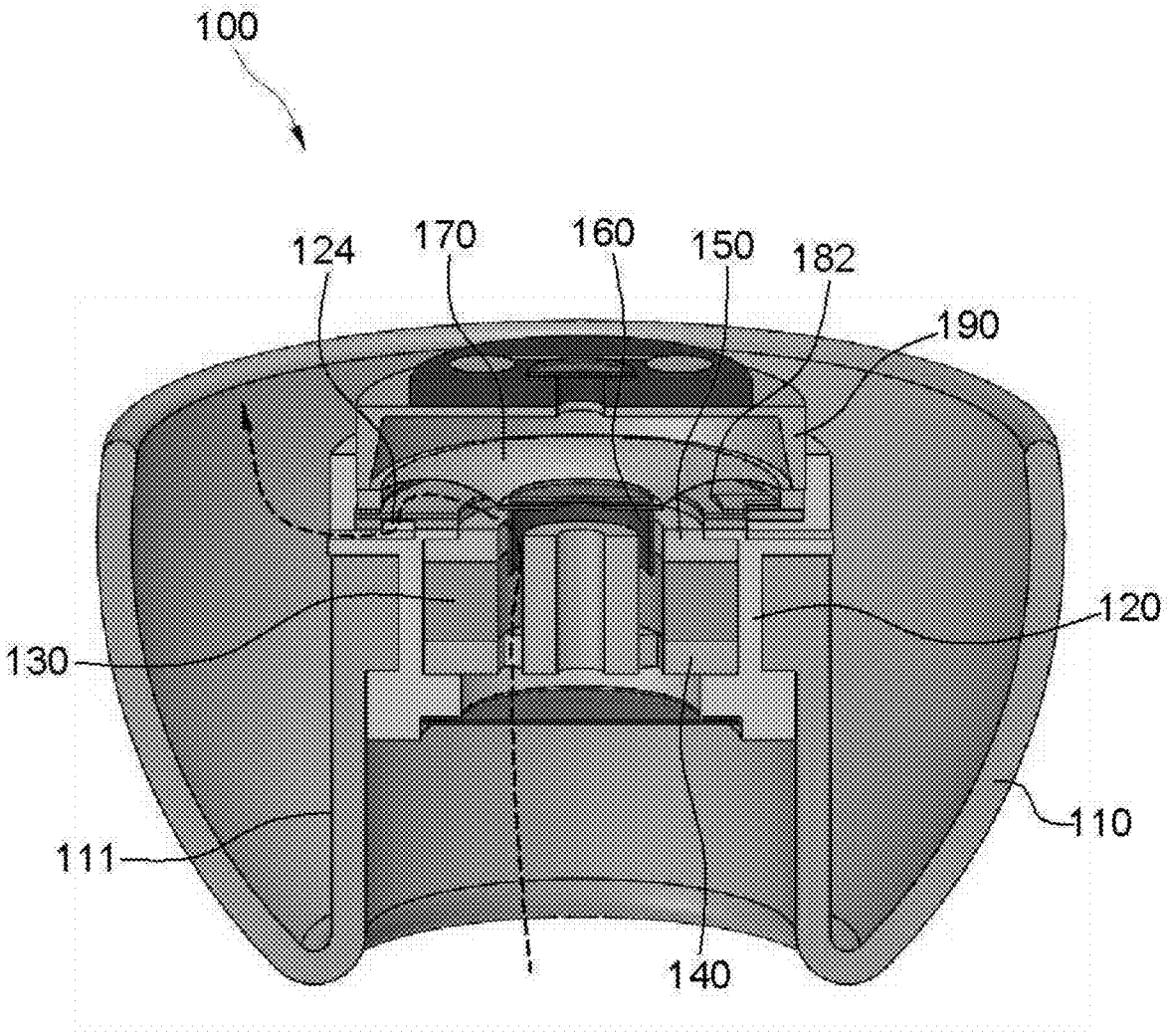
FIG. 2 is a diagram illustrating the configuration of an earphone having a nozzle-integrated structure with a DSF applied thereto according to another embodiment of the present invention.

Furthermore, in a second embodiment, a DSF structure that is applied to the nozzle-integrated earphone 100 is configured such that a DSF hole 124 is formed in one side of the edge of a seating surface, on which a retainer 120-side diaphragm 170 is seated and formed to communicate in a lateral direction and a mesh member 182 is interposed between the retainer 120 and the diaphragm 170 to be connected to the DSF hole 124, as shown in FIG. 2.

In this case, the mesh member 182 may be formed in a ring-shaped structure, may be disposed to cover the overall edge of the diaphragm 170, and may be disposed above the DSF hole 124.

In the DSF structure according to the second embodiment, the flow of pressurized air and sound is sent from a lower opening 101 through a yoke 140, a magnet 130, and a diaphragm 170, is filtered by the mesh member 182 having a ring-shaped structure, is passed through the DSF hole 124, is discharged in a lateral direction, is transferred to the eardrum through an upper opening 102.

In this case, due to the operation of the DSF structure in which the DSF hole 124 and the mesh member 182 are combined together, there may be provided the advantage of relieving eardrum pressure that frequently occurs when an earphone having a nozzle-integrated structure is worn in the ear.

Figure 3:
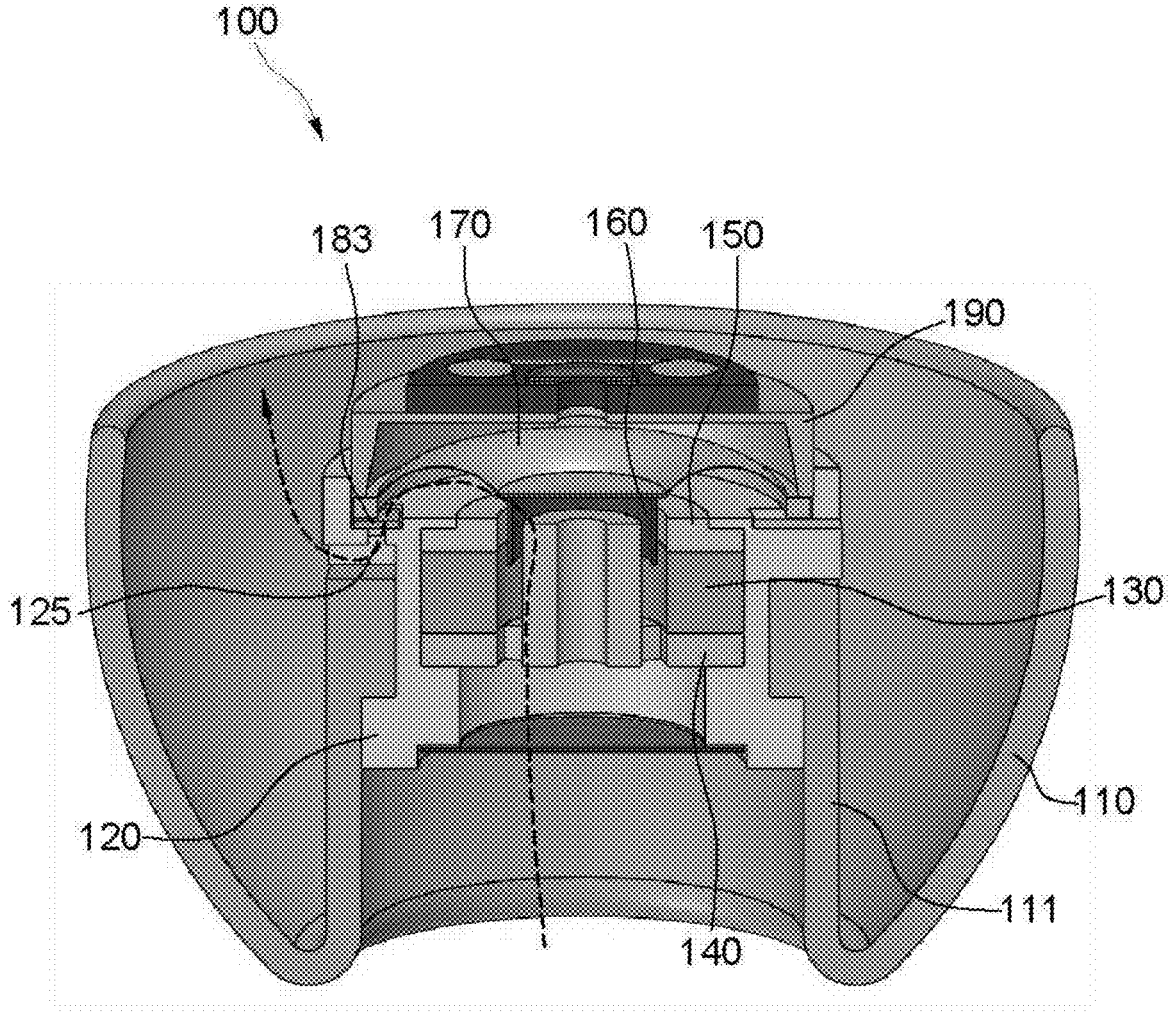
FIG. 3 is a diagram illustrating the configuration of an earphone having a nozzle-integrated structure with a DSF applied thereto according to still another embodiment of the present invention.

Furthermore, in a third embodiment, a DSF structure that is applied to a nozzle-integrated earphone 100 is configured such that a DSF hole 125 is formed in one side of the edge of the upper end portion of a retainer 120 and formed to communicate in a lateral direction and a mesh member 183 is interposed between the retainer 120 and a diaphragm 170 and disposed only over a portion in which the DSF hole 125 is formed, as shown in FIG. 3.

In the DSF structure according to the third embodiment, the flow of pressurized air and sound is sent from a lower opening 101 through a yoke 140, a magnet 130, and the diaphragm 170, is filtered by the mesh member 183, is discharged through the DSF hole 125 in a lateral direction, and is transferred to the eardrum through an upper opening 102.

In this case, due to the operation of the DSF structure in which the DSF hole 125 and the mesh member 183 are combined together, there may be provided the advantage of relieving eardrum pressure that frequently occurs when an earphone having a nozzle-integrated structure is worn in the ear.

Figure 4:
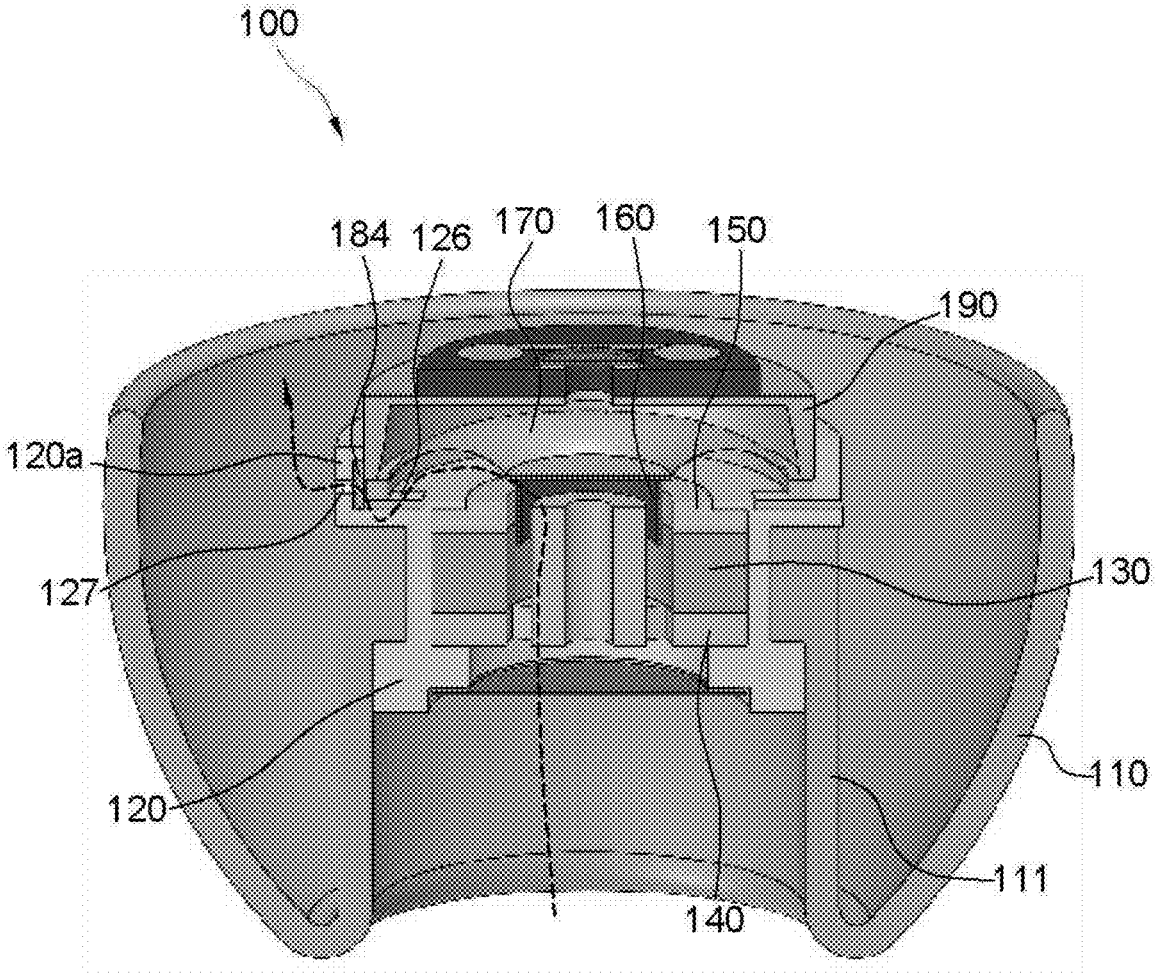
FIG. 4 is a diagram illustrating the configuration of an earphone having a nozzle-integrated structure with a DSF applied thereto according to still another embodiment of the present invention.

Furthermore, in a fourth embodiment, a DSF structure that is applied to a nozzle-integrated earphone 100 is configured such that a mesh member 184 is interposed upright between one side wall 120*a* of a seating surface, on which a retainer 120-side diaphragm 170 is seated, and the diaphragm 170, a DSF groove 126 is formed in one side edge of the seating surface on which the retainer 120-side diaphragm 170 is seated, and a DSF hole 127 is formed in one side wall of the retainer 120 to be connected to the DSF groove 126, as shown in FIG. 4.

In the DSF structure according to the fourth embodiment, the flow of pressurized air and sound is sent from a lower opening 101 through a yoke 140, a magnet 130 and the diaphragm 170, is guided through the DSF groove 126, is filtered while being passed through the mesh member 184, is discharged through the DSF hole 127 in a lateral direction, and is transferred to the eardrum through the upper opening 102.

In this case, due to the operation of the DSF structure in which the DSF groove 126, the mesh member 184 and the DSF hole 127 are combined together, there may be provided the advantage of relieving eardrum pressure that frequently occurs when an earphone having a nozzle-integrated structure is worn in the ear.

Figure 5:
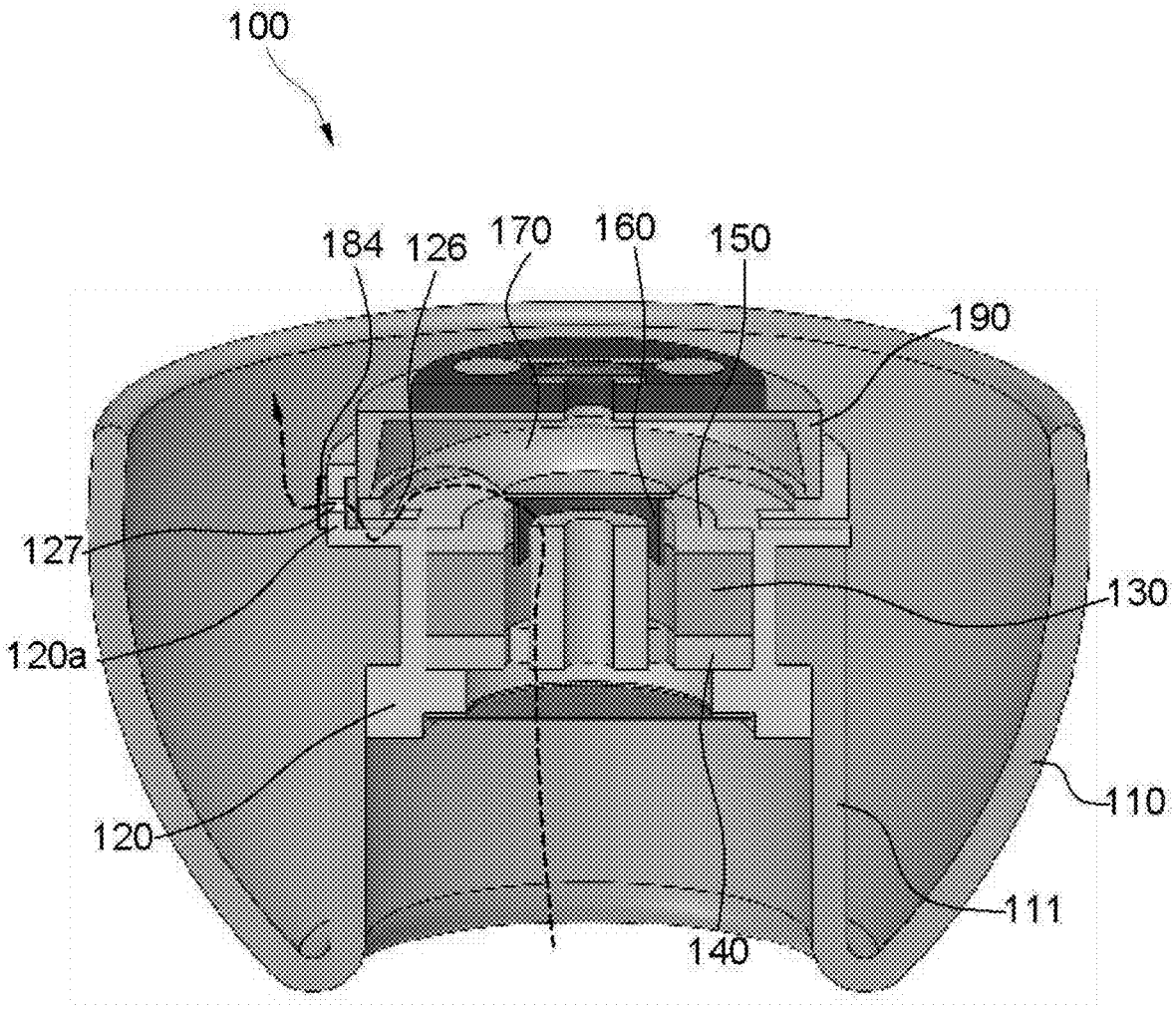
FIG. 5 is a diagram illustrating a configuration in which the location of a mesh member is changed in the embodiment of the present invention shown in FIG. 4.

Alternatively, in the above-described fourth embodiment, the mesh member 184 may be disposed at a location other than the location between the side wall 120*a* of the retainer 120 and the diaphragm 170. For example, as shown in FIG. 5, the mesh member 184 may be disposed outside the side wall 120*a* of the retainer 120 in which the DSF hole 127 is formed.

In this case, the flow of pressurized air and sound is sent from the lower opening 101 through the yoke 140, the magnet 130, and the diaphragm 170, is passed through the DSF groove 126 and the DSF hole 127, is filtered while being passed through the mesh member 184, is discharged in a lateral direction, and is transferred to the eardrum though the upper opening 102.

Accordingly, according to the present invention, via the above-described configuration, there may be provided the advantage of relieving eardrum pressure that is applied to the eardrum located at one end of the ear canal and frequently occurs when an earphone having a nozzle-integrated structure is inserted and worn into the ear.

The earphone having a nozzle-integrated structure with a DSF applied thereto according to the present invention has the usefulness of relieving eardrum pressure applied to the eardrum located at an end of the ear canal when the earphone having a nozzle-integrated structure is inserted and worn into the ear.

In particular, The earphone having a nozzle-integrated structure with a DSF applied thereto according to the present invention has the usefulness of relieving eardrum pressure by being combined with the DSF structure in which the DSF hole and the mesh member are disposed in a communication path through which the sound of the nozzle-integrated earphone is transferred.

The disclosed embodiments are intended merely to illustrate the technical spirit of the present invention. It will be apparent to those having ordinary skill in the art to which the present invention pertains that various modifications and alterations may be made to the disclosed embodiments without departing from the essential features of the present invention.

The disclosed embodiments are not intended to limit the technical spirit of the present invention, but are intended to illustrate the present invention. Accordingly, the scope of the present invention is not limited to the disclosed embodiments. The scope of the present invention should be interpreted based on the attached claims, and all technical spirits equal or equivalent to the claims should be interpreted as falling within the scope of the present invention.

What is claimed is:

1. An earphone having a nozzle-integrated structure with a DSF applied thereto, the earphone comprising:

a housing formed as a penetrated body forming an appearance of the earphone, and configured such that a nozzle portion is provided therein in an integrated structure;

a retainer configured to have a penetrated structure and to be fastened inside the housing;

a magnet configured to be fastened onto the retainer and to generate magnetic force;

a yoke configured to be located beneath the magnet and to concentrate magnetic force;

a plate configured to be located over the magnet and to collect magnetic force in a vertical direction;

a voice coil configured to be located on a side of the magnet and the plate, and to, when an electric signal having sound is applied, generate a magnetic field and vibrate through an interaction with the magnet; and a diaphragm configured to be fastened to a top of the retainer, to be located above the plate, and to vibrate and generate sound in response to vibration of the voice coil;

wherein a penetrated sleeve protruding upward from a lower end of the housing is provided inside the housing and forms a nozzle portion;

wherein the retainer is fastened to an upper end portion of the penetrated sleeve; and wherein a drum safety filter (DSF) hole is formed in one side of an edge of a seating surface, on which the retainer-side diaphragm is seated, to communicate in a lateral direction, and a mesh member is disposed below a portion of the retainer in which the DSF hole is formed.

2. An earphone having a nozzle-integrated structure with a DSF applied thereto, the earphone comprising:

a housing formed as a penetrated body forming an appearance of the earphone, and configured such that a nozzle portion is provided therein in an integrated structure;

a retainer configured to have a penetrated structure and to be fastened inside the housing;

a magnet configured to be fastened onto the retainer and to generate magnetic force;

a yoke configured to be located beneath the magnet and to concentrate magnetic force;

a plate configured to be located over the magnet and to collect magnetic force in a vertical direction;

a voice coil configured to be located on a side of the magnet and the plate, and to, when an electric signal having sound is applied, generate a magnetic field and vibrate through an interaction with the magnet; and a diaphragm configured to be fastened to a top of the retainer, to be located above the plate, and to vibrate and generate sound in response to vibration of the voice coil;

wherein a penetrated sleeve protruding upward from a lower end of the housing is provided inside the housing and forms a nozzle portion;

wherein the retainer is fastened to an upper end portion of the penetrated sleeve; and wherein a drum safety filter (DSF) hole is formed in one side of an edge of a seating surface on which the retainer-side diaphragm is seated and also formed to communicate in a lateral direction, and a mesh member is interposed between the retainer and the diaphragm to be connected with the DSF hole, formed in a ring-shaped structure, and disposed to cover an overall edge of the diaphragm.

3. An earphone having a nozzle-integrated structure with a DSF applied thereto, the earphone comprising:

a housing formed as a penetrated body forming an appearance of the earphone, and configured such that a nozzle portion is provided therein in an integrated structure;

a retainer configured to have a penetrated structure and to be fastened inside the housing;

a magnet configured to be fastened onto the retainer and to generate magnetic force;

a yoke configured to be located beneath the magnet and to concentrate magnetic force;

a plate configured to be located over the magnet and to collect magnetic force in a vertical direction;

a voice coil configured to be located on a side of the magnet and the plate, and to, when an electric signal having sound is applied, generate a magnetic field and vibrate through an interaction with the magnet; and a diaphragm configured to be fastened to a top of the retainer, to be located above the plate, and to vibrate and generate sound in response to vibration of the voice coil;

wherein a penetrated sleeve protruding upward from a lower end of the housing is provided inside the housing and forms a nozzle portion;

wherein the retainer is fastened to an upper end portion of the penetrated sleeve; and wherein a drum safety filter (DSF) hole is formed in one side of an edge of an upper end portion of the retainer to communicate in a lateral direction, and a mesh member is interposed between the retainer and the diaphragm and disposed only over a portion in which the DSF hole is formed.

4. An earphone having a nozzle-integrated structure with a DSF applied thereto, the earphone comprising:

a housing formed as a penetrated body forming an appearance of the earphone, and configured such that a nozzle portion is provided therein in an integrated structure;

a retainer configured to have a penetrated structure and to be fastened inside the housing;

a magnet configured to be fastened onto the retainer and to generate magnetic force;

a yoke configured to be located beneath the magnet and to concentrate magnetic force;

a plate configured to be located over the magnet and to collect magnetic force in a vertical direction;

a voice coil configured to be located on a side of the magnet and the plate, and to, when an electric signal having sound is applied, generate a magnetic field and vibrate through an interaction with the magnet; and a diaphragm configured to be fastened to a top of the retainer, to be located above the plate, and to vibrate and generate sound in response to vibration of the voice coil;

wherein a penetrated sleeve protruding upward from a lower end of the housing is provided inside the housing and forms a nozzle portion;

wherein the retainer is fastened to an upper end portion of the penetrated sleeve; and wherein a mesh member is interposed upright between one side wall of a seating surface, on which the retainer-side diaphragm is seated, and the diaphragm, a DSF groove is formed in one side of an edge of the seating surface on which the retainer-side diaphragm is seated, and a DSF hole is formed in one side wall of the retainer to be connected to the DSF groove.

5. The earphone according to claim 1, wherein a mounting recess is formed in an upper portion of an inner surface of the retainer, and the magnet, the yoke and the plate are fastened by being stacked and fitted into the mounting recess.

6. The earphone according to claim 2, wherein a mounting recess is formed in an upper portion of an inner surface of the retainer, and the magnet, the yoke and the plate are fastened by being stacked and fitted into the mounting recess.

7. The earphone according to claim 3, wherein a mounting recess is formed in an upper portion of an inner surface of the retainer, and the magnet, the yoke and the plate are fastened by being stacked and fitted into the mounting recess.

8. The earphone according to claim 4, wherein a mounting recess is formed in an upper portion of an inner surface of the retainer, and the magnet, the yoke and the plate are fastened by being stacked and fitted into the mounting recess.

9. The earphone according to claim 1, wherein a fastening protrusion protruding inward is formed on an upper end portion of an inner surface of the sleeve, a fastening recess corresponding to the fastening protrusion of the sleeve is formed in an outer surface of the retainer, and the retainer is fitted into the sleeve via the fastening protrusion and the fastening recess.

10. The earphone according to claim 2, wherein a fastening protrusion protruding inward is formed on an upper end portion of an inner surface of the sleeve, a fastening recess corresponding to the fastening protrusion of the sleeve is formed in an outer surface of the retainer, and the retainer is fitted into the sleeve via the fastening protrusion and the fastening recess.

11. The earphone according to claim 3, wherein a fastening protrusion protruding inward is formed on an upper end portion of an inner surface of the sleeve, a fastening recess corresponding to the fastening protrusion of the sleeve is formed in an outer surface of the retainer, and the retainer is fitted into the sleeve via the fastening protrusion and the fastening recess.

12. The earphone according to claim 4, wherein a fastening protrusion protruding inward is formed on an upper end portion of an inner surface of the sleeve, a fastening recess corresponding to the fastening protrusion of the sleeve is formed in an outer surface of the retainer, and the retainer is fitted into the sleeve via the fastening protrusion and the fastening recess.

* * * * *